US005513154A

United States Patent [19]

Beckwith

[11] Patent Number: 5,513,154

[45] Date of Patent: Apr. 30, 1996

[54] WRIST WATCH WITH BENDABLE ARMS

[76] Inventor: Jacqueline C. Beckwith, 114 Pilgrim Rd., Wellesley, Mass. 02181

[21] Appl. No.: 384,933

[22] Filed: Feb. 7, 1995

[51] Int. Cl.[6] ..... G04B 37/00

[52] U.S. Cl. ..... 368/281

[58] Field of Search ..... 368/280–285

[56] References Cited

U.S. PATENT DOCUMENTS

| | | | |
|---|---|---|---|
| 2,840,286 | 6/1958 | Schermerhorn | 368/282 |
| 4,794,578 | 12/1988 | Leo | 368/316 |
| 4,855,972 | 8/1989 | Eiss | 368/282 |
| 4,939,913 | 7/1990 | Scungio et al. | 368/285 |

FOREIGN PATENT DOCUMENTS

| | | | |
|---|---|---|---|
| 9293 | 1/1991 | Japan | 368/285 |
| 213094 | 8/1992 | Japan | 368/285 |
| 2147717 | 5/1985 | United Kingdom | 368/282 |

*Primary Examiner*—Bernard Roskoski
*Attorney, Agent, or Firm*—Brian M. Dingman

[57] ABSTRACT

An adjunct for a wrist watch, comprising an elongated, bendable body section, connected at one end to the body of the wrist watch.

12 Claims, 5 Drawing Sheets

WRIST WATCH WITH BENDABLE ARMS

BACKGROUND OF INVENTION

This invention relates to a wrist watch with novelty decorative arms projecting from the wrist watch body.

BACKGROUND OF INVENTION

Wrist watches are, most basically, utilitarian objects. More recently, watches have become more decorative. The watch faces and bands have become more colorful. To date, however, adjuncts to the watch itself have not been available. Such adjuncts could be used to change the appearance of the wrist watch, and the manner in which it is used.

SUMMARY OF THE INVENTION

It is therefore an object of this invention to provide a wrist watch adjunct which alters the basic appearance of the watch.

It is a further object of this invention to provide such an adjunct which can be used to alter the manner in which a wrist watch is worn.

It is a further object of this invention to provide the means for an individual to change the wrist watch appearance by herself.

This invention features a wrist watch with adjuncts taking the form of long projecting members that may be bent to a desired shape. In one embodiment, the adjuncts are in the form of elongated arms with hands on the end. The arms may be wrapped around the wrist of the wearer after the watch is placed on the wrist. Other adjunct shapes are also contemplated herein. The adjuncts may be replaceable so that the user can alter the appearance and function of the wrist watch as desired within the bounds of adjuncts which are available.

BRIEF DESCRIPTION OF THE DRAWINGS

Other objects, features and advantages will occur to those skilled in the art from the following description of a preferred embodiment and the accompanying drawings, in which.

DESCRIPTION OF THE PREFERRED EMBODIMENT

The wrist watch of this invention is accomplished with one or more adjuncts which are connected to the watch body. The connection may be accomplished by any of a number of means, including an enlarged end which is held within the watch body. The body of the adjunct in that case is thinner than the enlarged end, and passes through an opening in the watch body which is the size of the body to retain the enlarged end within the watch body, and thus connect the adjunct to the watch body. Alternatively, the adjunct may be made removable by a desirable mechanical means, for example by including a slot rather than an opening for the body of the adjunct to pass through the side wall of the watch body, still employing the enlarged end that is retained within the watch body. Access to the slot may be provided by having a removable watch face overlay the open end of the slot, or by other equivalent mechanical means.

The watch body may be made easily removable from the watch band so that the body with the attached adjunct or adjuncts can be worn in other manners by the user. In this case, the watch body can be attached by the adjuncts to bookbags, arms, thighs, or other structures or parts of the body.

Figure 1:
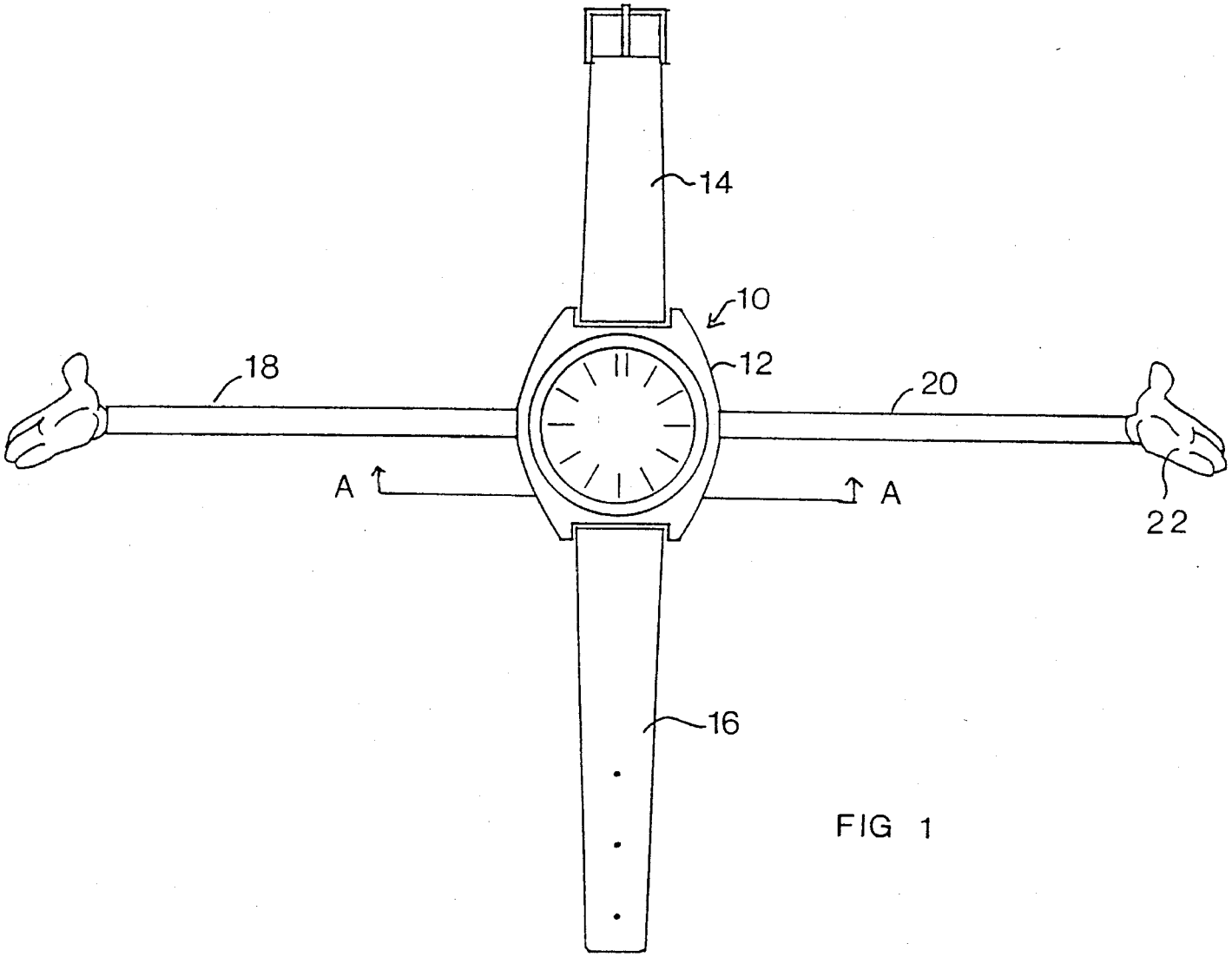
FIG. 1 is a top plan view of a wrist watch with two adjuncts according to this invention.

There is shown in FIG. 1 wrist watch 10 having adjuncts 18 and 20 according to this invention connected to watch body 12. The wrist band is comprised of standard wrist band portions 14 and 16.

Figure 1A:
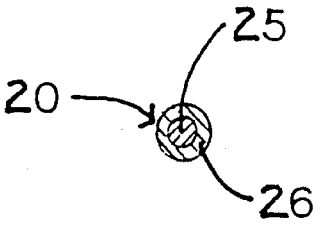
FIG. 1A is a cross-sectional view of the elongated body of an adjunct of FIG. 1.
Figure 4:
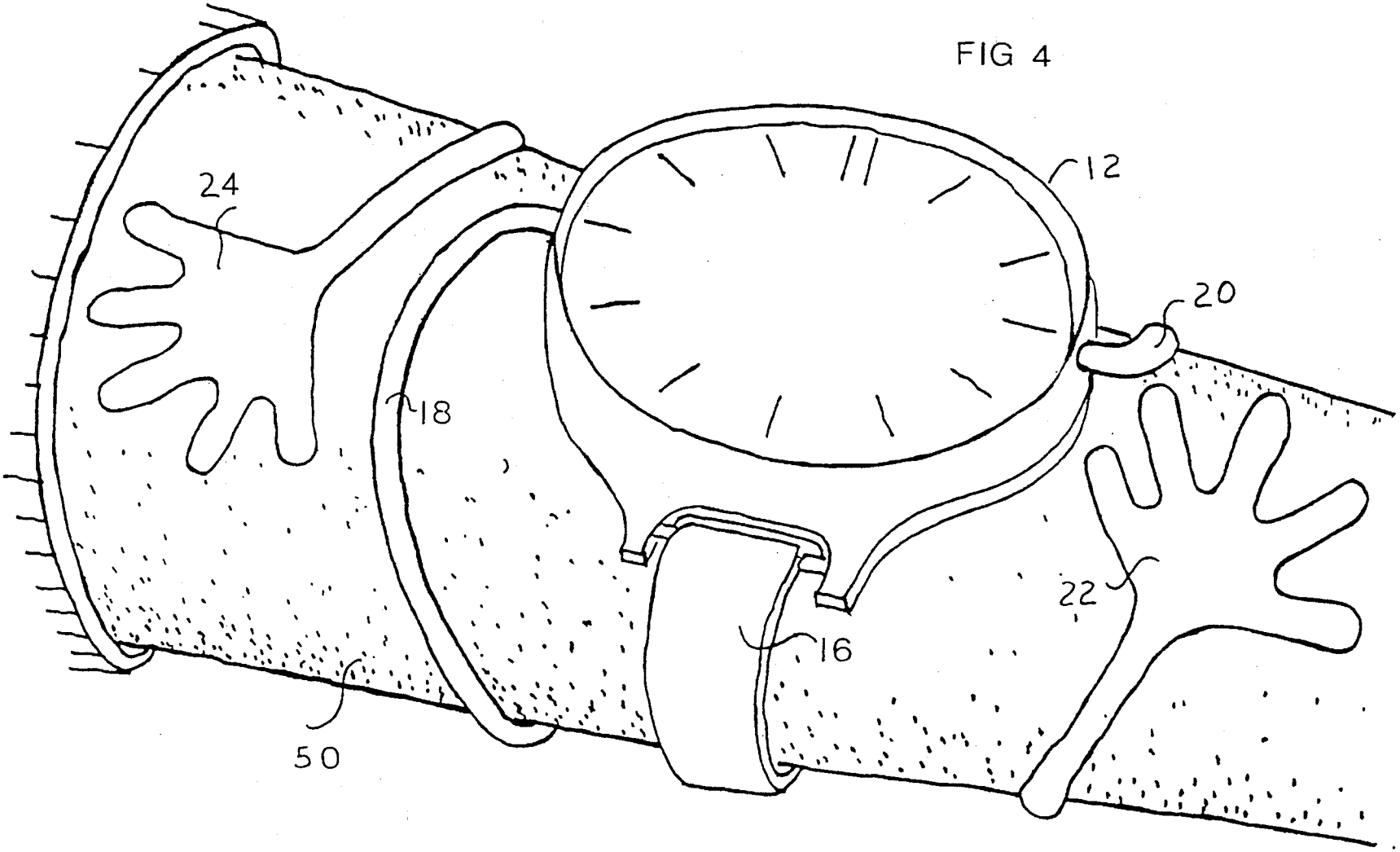
FIG. 4 is a perspective view of the watch of FIG. 1 on the arm of a user.

This invention contemplates the provision of one or more adjuncts which are connected, or connectable to, the wrist watch body. In this case, adjuncts 18 and 20 are identical and each include a decorative portion at the distal end, such as shown by hand 22. Adjuncts 18 and 20 are bendable. Preferably, adjuncts 18 and 20 are adapted to retain their bent shape so that they can be wrapped around the arm of the user as shown in FIG. 4. This may be accomplished as shown in FIG. 1A by the use of a soft metal wire core 25 surrounded by a plastic sleeve 26.

Figure 2:
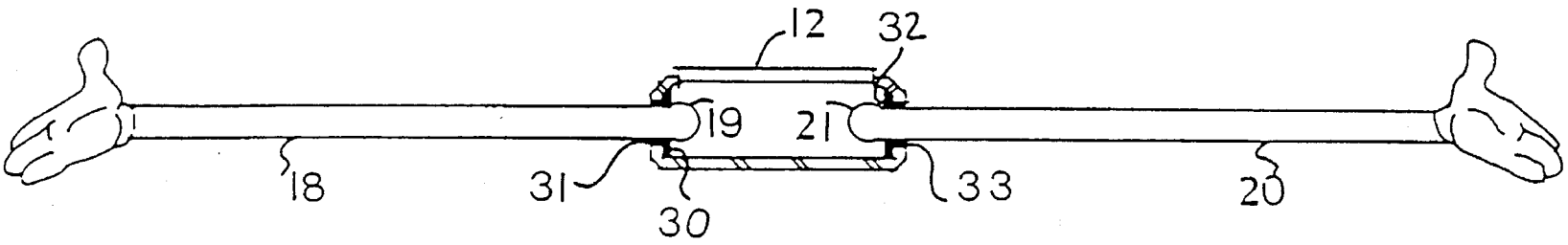
FIG. 2 is a cross section taken along line A—A of FIG. 1.
Figure 3:
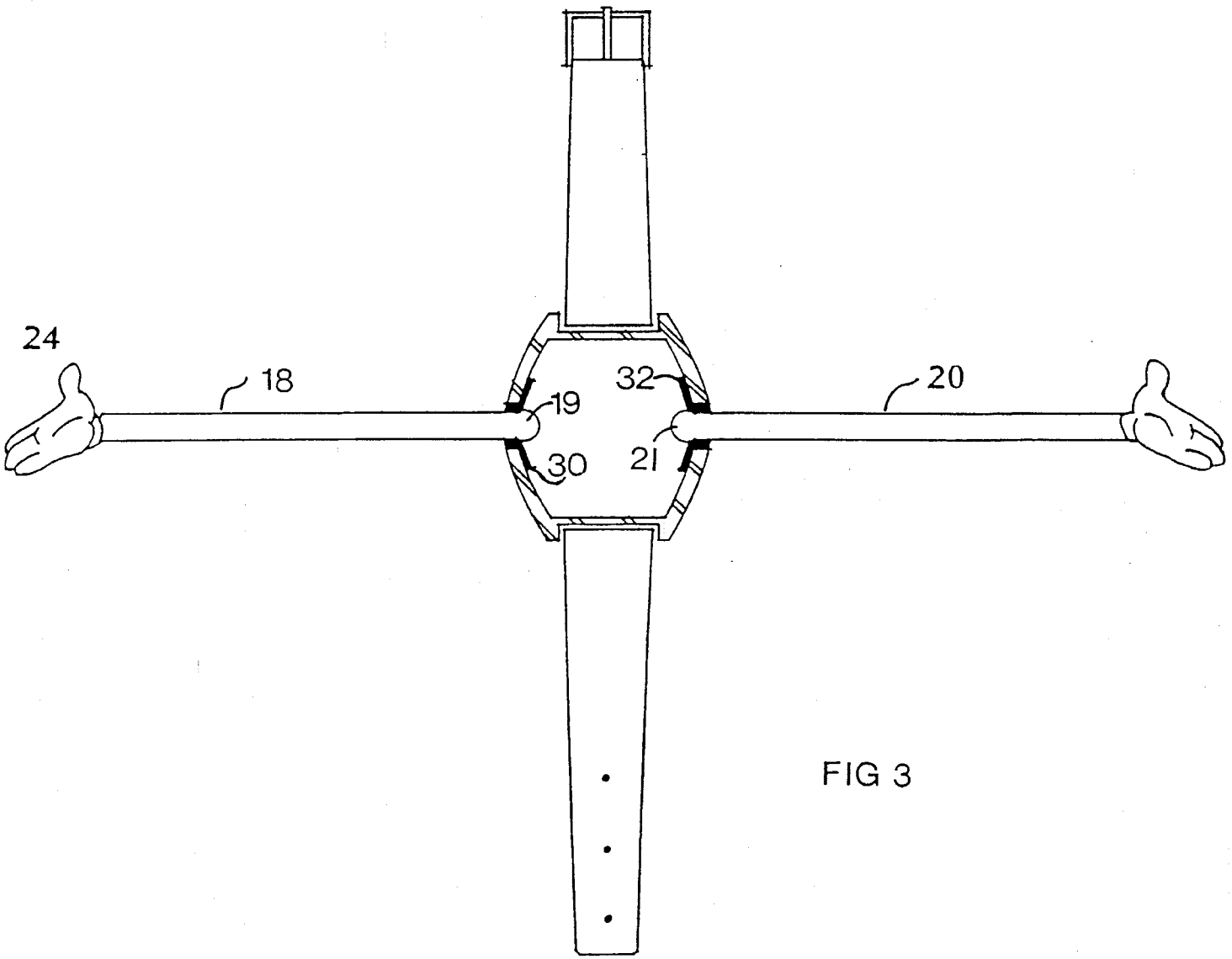
FIG. 3 is a cross section taken along line B—B of FIG. 2.

As shown in the cross sections of FIGS. 2 and 3, the adjuncts are preferably connected to the watch body by way of an enlarged end which fits inside of the watch body. For example, ends 19 and 21 of adjuncts 18 and 20, respectively, are shown as fitting within watch body 12. Those enlarged ends are maintained within the watch by providing openings 31 and 33 which, when the watch is constructed, are smaller than the diameter of enlarged ends 19 and 21. The body portion of the adjuncts (the portion between the enlarged end, and the second end carrying a decorative portion) fit through the openings.

The construction shown in these drawings accomplishes these design criteria with an annular sleeve 30, 32 which has a smaller end which fits within openings 31, 33, respectively. The other end of each of members 30, 32 is larger than openings 31, 33, to maintain the sleeves in place. The central opening through sleeves 31 and 33 are large enough to allow the elongated body portion of an adjunct member to pass therethrough, but smaller than the diameter of the enlarged ball end of the member.

It should be understood that this is simply one manner of connecting an adjunct to a watch body, and other methods of such connection are contemplated herein. Also, the adjuncts may be made user-removable from the watch body so that they can be removed altogether, or replaced with other adjuncts which fit within the adjunct-connection structures of the watch. This may be accomplished by the use of a slot rather than a hole for receiving the elongated body portion of the adjunct, and some means for closing the open end of the slot. This closure may be provided by a removable part which may be the watch face; such removable watch faces are known in the art of wrist watch manufacturing.

Figure 5B:
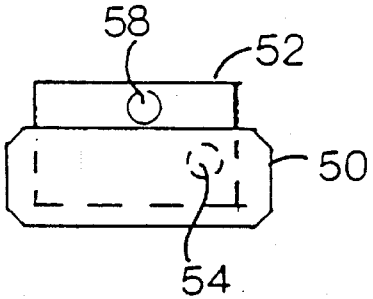
FIG. 5B is a partial side elevational view of the watch body and watch body carrying frame of FIG. 5A.
Figure 5A:
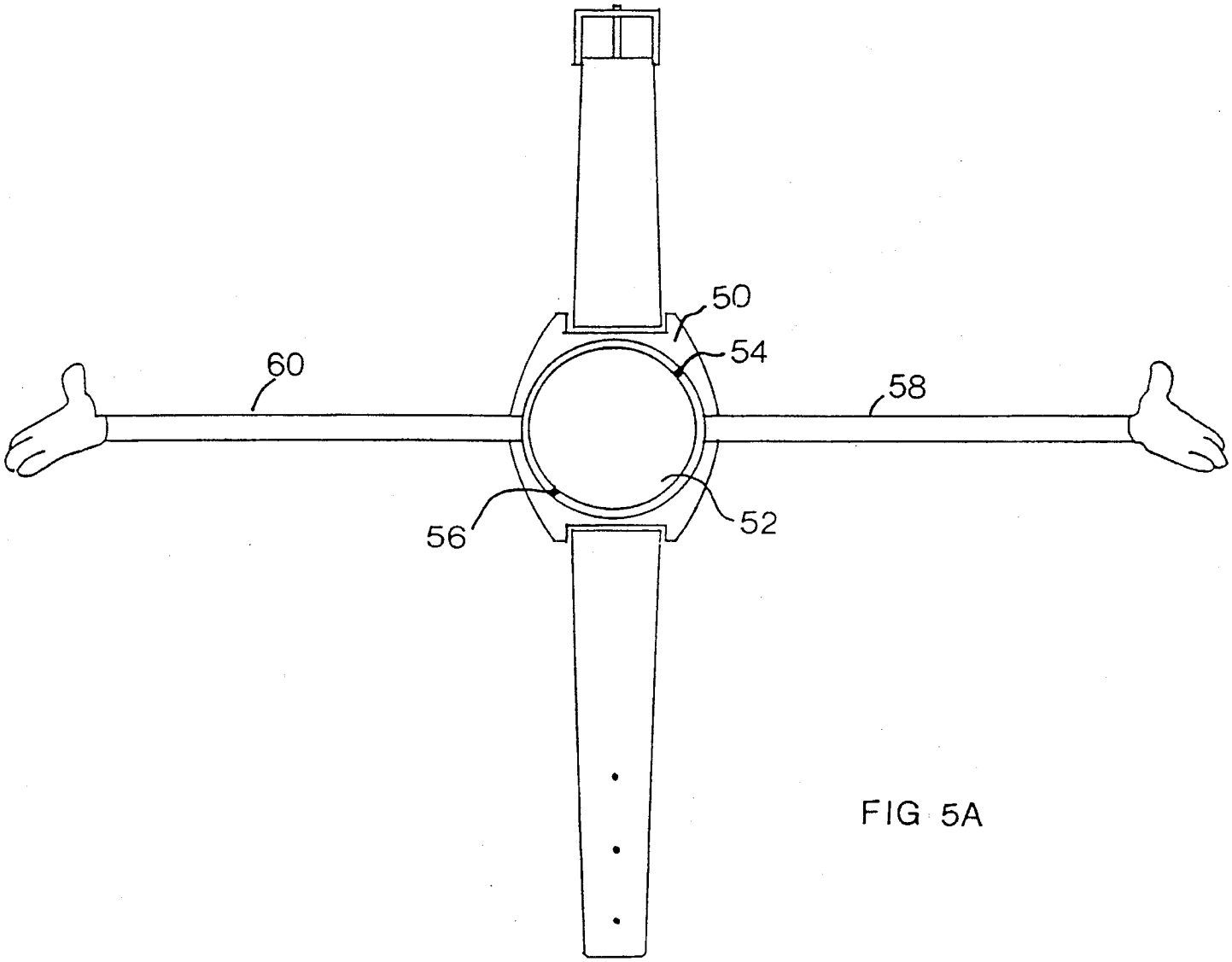
FIG. 5A is a top plan view of an embodiment in which the watch body and connected adjuncts is removable from the watch band.

FIG. 5A details an embodiment of a watch according to this invention in which the watch body can be easily detached from the watch band. This allows the watch body to be attached by way of the bendable adjuncts to other parts of the body, or other structures such as a bookbag or notebook ring, for example. In this embodiment, watch body 52 is made to be carried within watch body carrying frame 50 which is an annular frame with an open front and back.

Watch body 52 is held within frame 50 by detents 54 and 56, which allow body 52 to be removed from frame 50 by pressing on the underside of watch body 52. As best shown in FIG. 5B, adjuncts 58 and 60 are attached to watch body 52 in the area of watch body 52 which sits above frame 50 so that the watch body with connected adjuncts can be removed from the watchband.

This is but one manner of providing a detachable watch body according to this invention. Other manners of detachment are contemplated, for example by designing the watch band to be easily removed from the watch body, there would be no need for a separate watch body carrying frame as disclosed in FIGS. 5A and 5B.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A wrist watch construction, comprising:

a wrist watch with a a watch body and means for attaching a watch band; and a pair of elongated, bendable adjuncts connected to the watch body on opposite sides to project from the watch body, said adjuncts being capable of retaining their bent form, and each including a decorative enlarged feature at its distal end;

wherein said adjuncts each project from the watch body a sufficient distance to wrap substantially completely around a human wrist, to allow said watch body to be held on a wrist by said adjuncts.

2. The adjunct of claim 1 in which said means for connecting includes an enlarged end on said adjunct.

3. The adjunct of claim 2 in which said means for connecting further includes an opening in the wrist watch body smaller than said enlarged end.

4. The adjunct of claim 3 in which said opening includes an adjunct-receiving member fitted into the watch body, with an adjunct-receiving opening for allowing the adjunct body to pas therethrough.

5. The adjunct of claim 4 in which said adjunct-receiving member includes a first projecting portion for fitting into an opening in the watch body, and a second, larger, portion fitting against the inside of the watch body for retaining the member in the opening.

6. The adjunct of claim 4 in which the opening includes an open-end slot.

7. The adjunct of claim 4 in which the opening includes a hole.

8. The wrist watch of claim 1 in which said adjuncts are permanently connected to the watch body.

9. The wrist watch of claim 1 in which said adjuncts are removably connected to the watch body by a means for connecting one end of the adjunct to the wrist watch body.

10. The wrist watch of claim 1 in which said adjuncts are made from coated wire.

11. The wrist watch of claim 10 in which said wire is metal.

12. The wrist watch of claim 11 in which the metal wire is coated with a plastic substance.

* * * * *